US007320537B1

(12) United States Patent
Stillwaugh

(10) Patent No.: US 7,320,537 B1
(45) Date of Patent: Jan. 22, 2008

(54) WORK LIGHT APPARATUS

(76) Inventor: Jim P. Stillwaugh, 48 Millbrook Rd., P.O. Box 134, Broadway, NJ (US) 08808

( * ) Notice: Subject to any disclaimer, the term of this patent is extended or adjusted under 35 U.S.C. 154(b) by 84 days.

(21) Appl. No.: 11/329,734

(22) Filed: Jan. 12, 2006

(51) Int. Cl.
*F21V 21/00* (2006.01)

(52) U.S. Cl. ..... 362/398; 362/285; 362/376

(58) Field of Classification Search ..... 362/398, 362/376, 396, 285, 319
See application file for complete search history.

(56) References Cited

U.S. PATENT DOCUMENTS

| | | | | | |
|---|---|---|---|---|---|
| 1,932,143 | A | * | 10/1933 | Piercy | 362/398 |
| 2,460,173 | A | * | 1/1949 | Halbing | 362/376 |
| 2,747,079 | A | * | 5/1956 | Kubiliunas | 362/398 |
| 2,987,612 | A | * | 6/1961 | Haulter | 362/296 |
| 3,325,639 | A | * | 6/1967 | King | 362/270 |
| 4,564,894 | A | | 1/1986 | Gonzalez | |
| 4,727,462 | A | | 2/1988 | Komonko | |
| 4,881,155 | A | | 11/1989 | Gahagan | |
| 5,213,412 | A | * | 5/1993 | Ciallella | 362/398 |
| D344,150 | S | | 2/1994 | Umhauser | |
| 5,416,685 | A | * | 5/1995 | Myers | 362/398 |
| 5,457,619 | A | | 10/1995 | Ewing | |
| 5,467,261 | A | * | 11/1995 | Whetstone | 362/398 |
| 5,568,968 | A | * | 10/1996 | Jaramillo | 362/376 |
| 6,206,542 | B1 | | 3/2001 | Case et al. | |
| 2006/0034091 | A1 | * | 2/2006 | Kovacik et al. | 362/398 |

* cited by examiner

*Primary Examiner*—Sandra O'Shea
*Assistant Examiner*—Gunyoung T Lee

(57) ABSTRACT

A work light apparatus includes a housing that has a top wall, a bottom wall and a peripheral wall extending between and attached to the top and bottom walls. A portion of the housing comprises a cage extending from the bottom wall and through the top wall. A light socket is mounted in the housing adjacent to the bottom wall. A light bulb mounted in the light socket emits light outwardly through the cage. An electrical cord is electrically coupled to the light socket. A back magnet is attached to an outer surface of a solid portion of the peripheral wall. The back magnet is positioned opposite of the cage and is configured to releasably couple the housing to a metallic surface attracted to magnets.

3 Claims, 4 Drawing Sheets

WORK LIGHT APPARATUS

BACKGROUND OF THE INVENTION

1. Field of the Invention

The present invention relates to work light devices and more particularly pertains to a new work light device for mounting on metallic surfaces to provide light where needed while working on a vehicle or other metallic object.

2. Description of the Prior Art

The use of work light devices is known in the prior art. While these devices fulfill their respective, particular objectives and requirements, the need remains for a light emitting device that allows a person to attach a work light directly adjacent to a work area without the need of hooks or catches upon which the hook may be attached. This will allow for more versatile angle orientations of light emitting devices.

SUMMARY OF THE INVENTION

The present invention meets the needs presented above by generally comprising a housing that has a top wall, a bottom wall and a peripheral wall extending between and attached to the top and bottom walls. A portion of the housing comprises a cage extending from the bottom wall and through the top wall. A light socket is mounted in the housing adjacent to the bottom wall. A light bulb may be removably mounted in the light socket and light emitted by the light bulb shines outwardly through the cage. An electrical cord is electrically coupled to the light socket. A back magnet is attached to an outer surface of a solid portion of the peripheral wall. The back magnet is positioned opposite of the cage and is configured to releasably couple the housing to a metallic surface attracted to magnets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
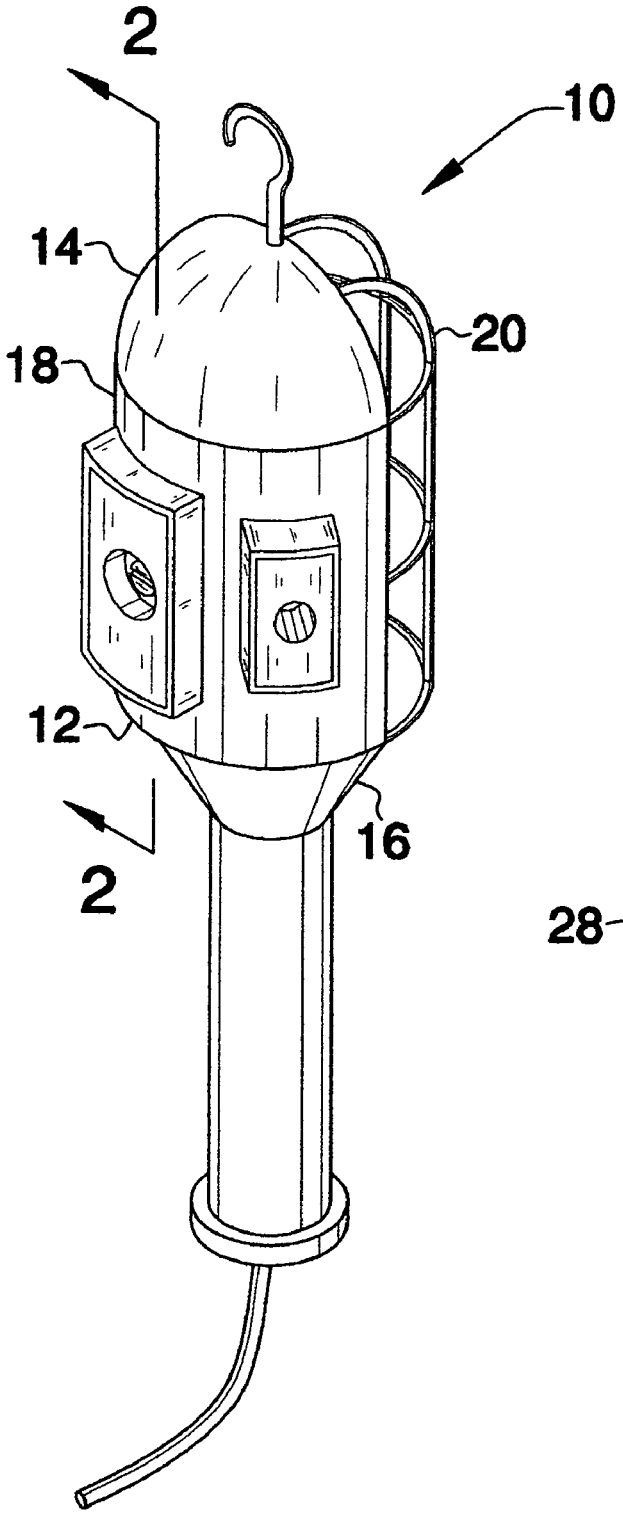
FIG. 1 is a perspective view of a work light apparatus according to the present invention.
Figure 2:
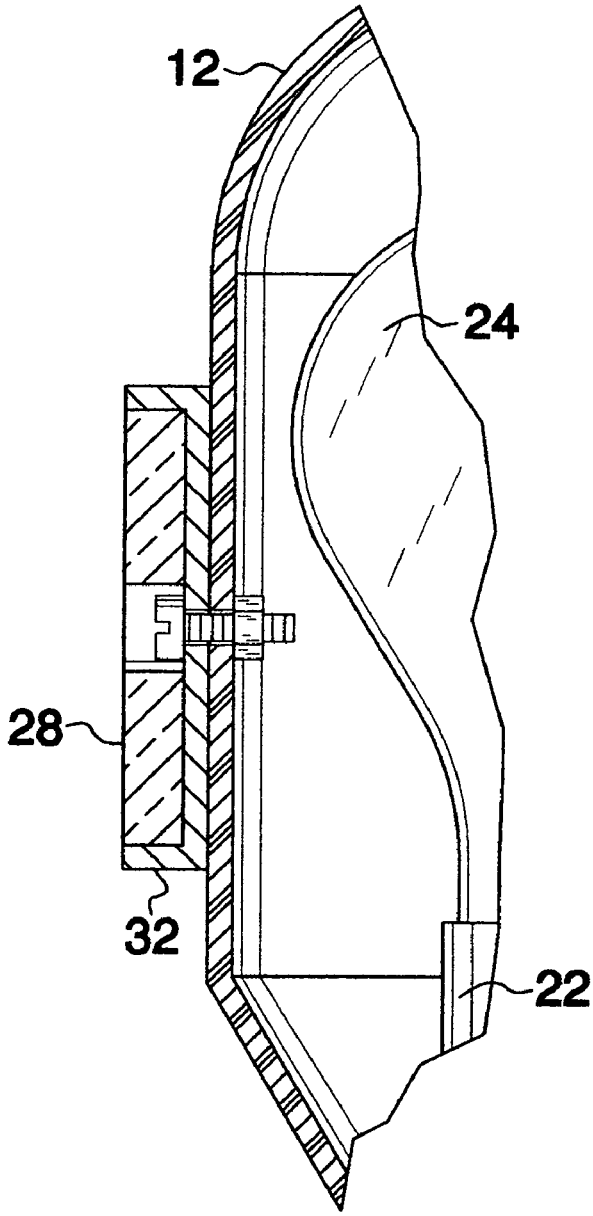
FIG. 2 is a cross-sectional view taken along line 2-2 of FIG. 1 of the present invention.
Figure 3:
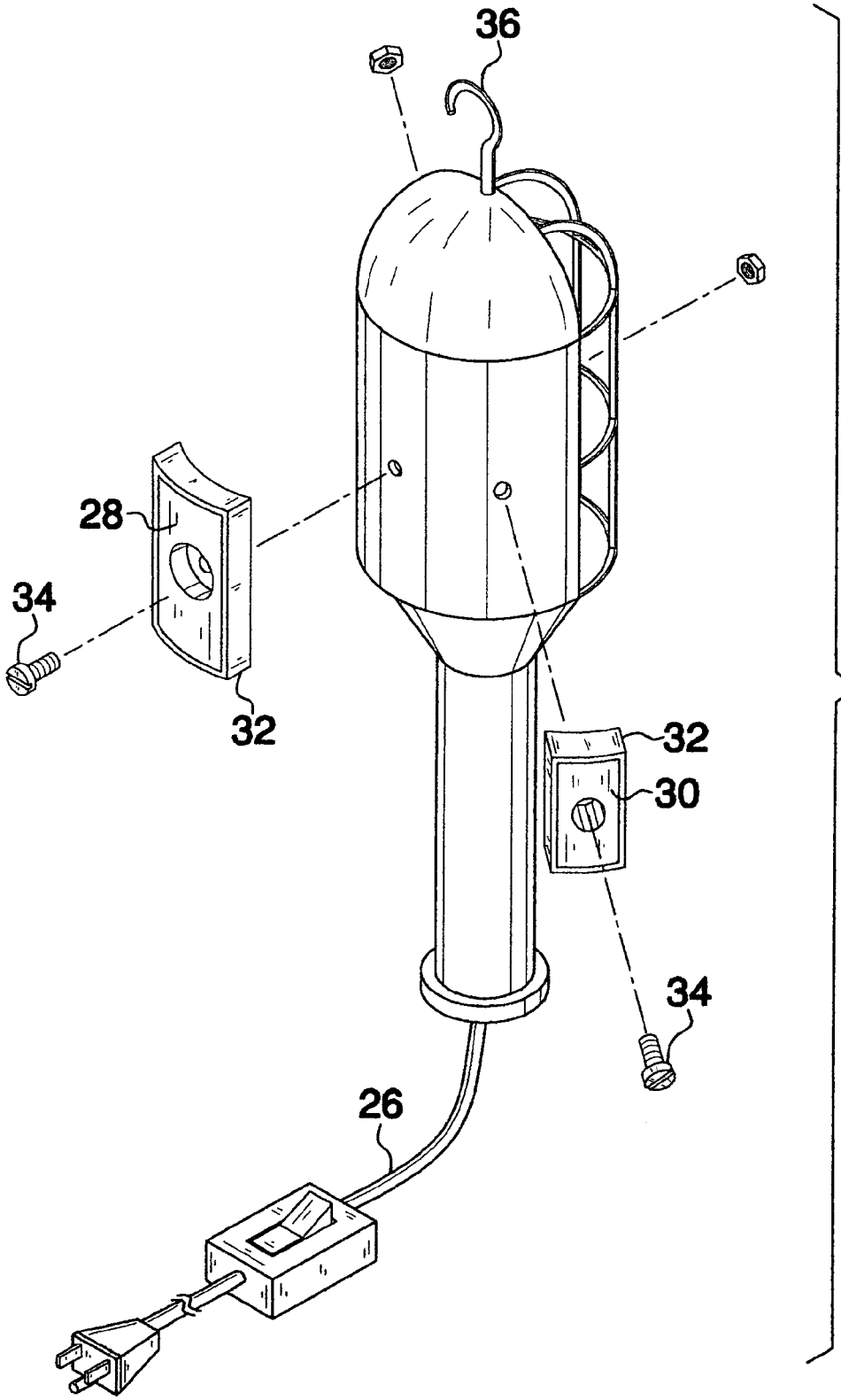
FIG. 3 is a perspective view of the present invention.

With reference now to the drawings, and in particular to FIGS. 1 through 6 thereof, a new work light device embodying the principles and concepts of the present invention and generally designated by the reference numeral 10 will be described.

As best illustrated in FIGS. 1 through 6, the work light apparatus 10 generally comprises a housing 12 that has a top wall 14, a bottom wall 16 and a peripheral wall 18 extending between and is attached to the top 14 and bottom 16 walls. A portion of the housing 12 comprises a cage 20 extending from the bottom wall 16 and through the top 14 wall. A light socket 22 is mounted in the housing 12 adjacent to the bottom wall 16. A light bulb 24 is removably mounted in the light socket 22 and light emitted by the light bulb 24 shines outwardly through the cage 20. An electrical cord 26 for electrically coupling the light socket 22 to a power outlet is electrically coupled to the light socket 22. The housing 12, light socket 22 and cord 26 are generally conventional for a work light used by automotive repair facilities.

A back magnet 28 is attached to an outer surface of a solid portion of the peripheral wall 18. The back magnet 28 is positioned opposite of the cage 20 and is configured to releasably couple the housing 12 to a metallic surface attracted to magnets. Such metallic surfaces may include steel, nickel, iron and cobalt. A lateral magnet 30 is attached to the outer surface of the solid portion of the peripheral wall 18. The lateral magnet 30 is positioned between the back magnet 28 and the cage 20. The lateral magnet 30 is configured to releasably couple the housing to a metallic surface attracted to magnets. The back 28 and lateral 30 magnets are each housed in a mounting 32 that attachable to the housing 12 with a threaded fastener 34. This allows the lateral 30 and back 28 magnets to be removed if needed. A hook 36 is attached to the top wall 14. The hook 36 may be threadably coupled to an aperture 38 extending through the top wall 14.

Figure 4:
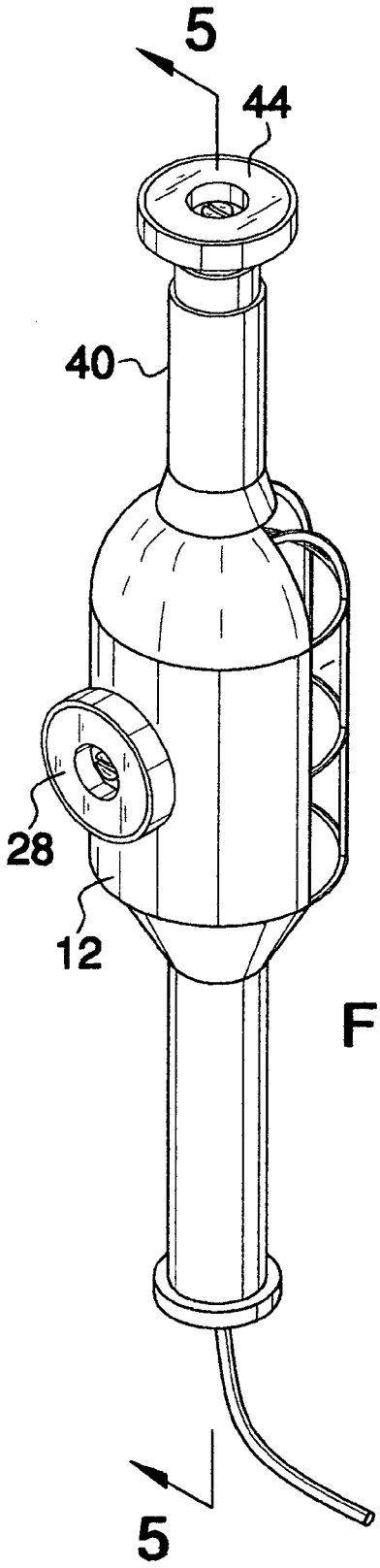
FIG. 4 is a perspective view of a second embodiment of the present invention.
Figure 5:
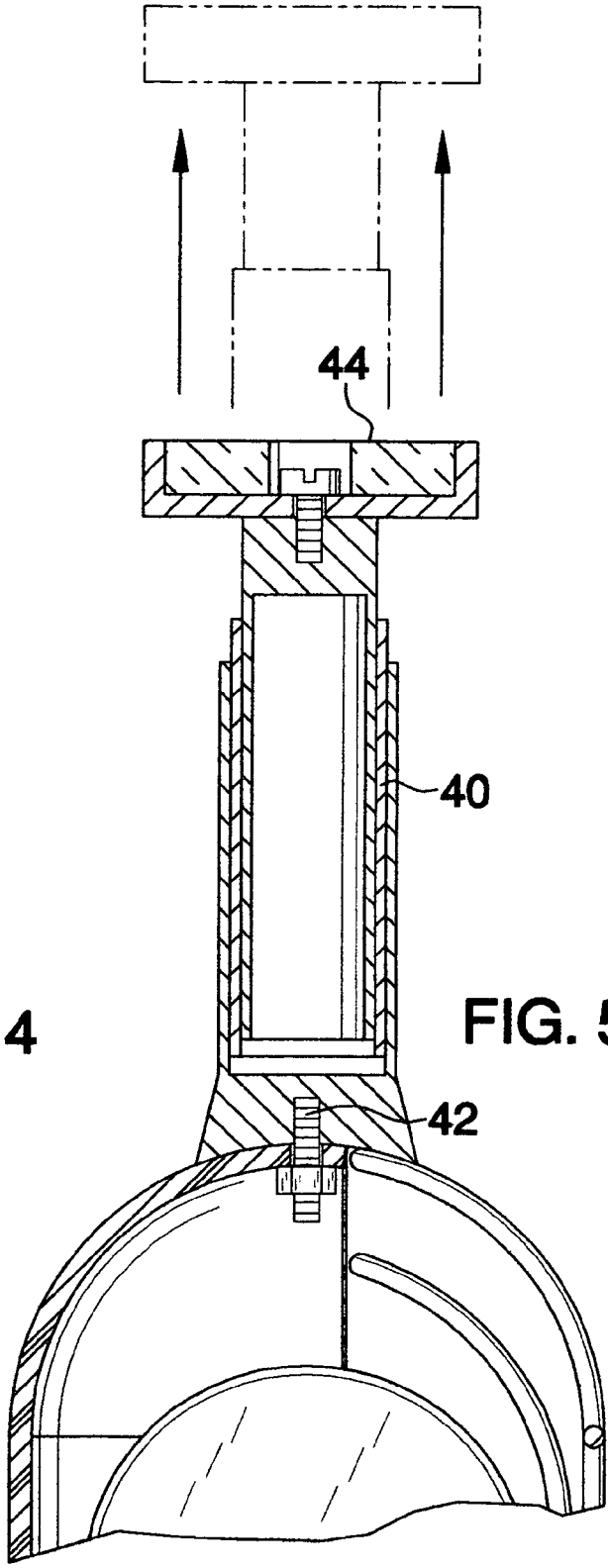
FIG. 5 is a cross-sectional view taken along line 5-5 of FIG. 4 of the present invention.
Figure 6:
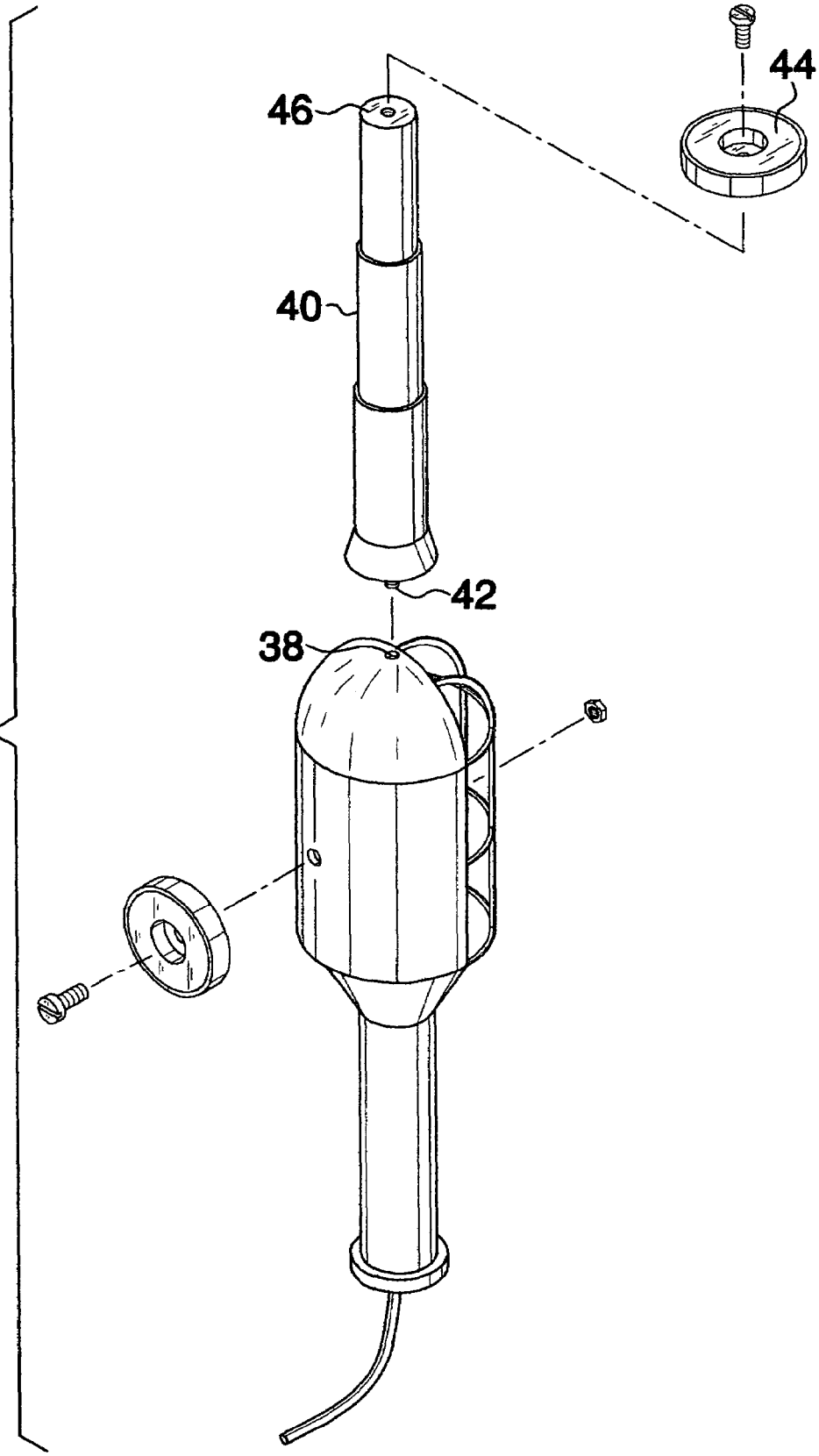
FIG. 6 is a perspective exploded view of the second embodiment of the present invention.

FIGS. 4-6 show an arm 40 that may be attached to and extended upwardly away from the top wall 14 by means of a threaded post 42 that is extended through the aperture 38 in the top wall 14. A top magnet 44 is attached to a distal end 46 of the arm 40 with respect to the top wall 14. The top magnet 44 is substantially planar and lies a plane orientated substantially perpendicular to a longitudinal axis of the arm 40. The top magnet 44 is configured to releasably couple the housing 12 to a metallic surface attracted to magnets. The arm 40 may be telescopic so that it has a selectively adjustable length. FIGS. 4-6 also show a different shaped back magnet 28 than shown in FIGS. 1-3 and it should be understood that the back magnet 28 may be removed from the housing 12 and then attached to the arm 40 to also define the top magnet 44. Different shaped magnets may also be used for attaching the housing 12 to curved surfaces.

In use, the apparatus 10 is generally used as a conventional shop light, but may be attached to portions of a vehicle with one of the magnets 28, 30, 44 when a suitable catch is not available for the hook 36 or when the user of the apparatus 10 desires the light bulb 24 to emit light at a different angle than can be achieved with the hook 36.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A work light assembly comprising;

a housing having a top wall, a bottom wall and a peripheral wall extending between and being attached to said top and bottom walls, a portion of said housing comprising a cage extending from said bottom wall and through said top wall, a light socket being mounted in said housing adjacent to said bottom wall, wherein a light bulb being removably mounted in said light socket and light emitted by said light bulb shines outwardly through said cage, an electrical cord for electrically coupling said light socket to a power outlet being electrically coupled to said light socket;

a back magnet being attached to an outer surface of a solid portion of said peripheral wall, said back magnet being positioned opposite of said cage, said back magnet being configured to releasably couple said housing to a metallic surface attracted to magnets;

an arm being attached to and extending upwardly away from said top wall;

a top magnet being attached to a distal end of said arm with respect to said top wall, said top magnet being substantially planar and lying a plane orientated substantially perpendicular to a longitudinal axis of said arm, said top magnet being configured to releasably couple said housing to a metallic surface attracted to magnets, said arm being telescopic and having a selectively adjustable length.

2. The assembly according to claim 1, further including a lateral magnet being attached to said outer surface of said solid portion of said peripheral wall, said lateral magnet being positioned between said back magnet and said cage, said lateral magnet being configured to releasably couple said housing to a metallic surface attracted to magnets.

3. A work light assembly comprising;

a housing having a top wall, a bottom wall and a peripheral wall extending between and being attached to said top and bottom walls, a portion of said housing comprising a cage extending from said bottom wall and through said top wall, a light socket being mounted in said housing adjacent to said bottom wall, wherein a light bulb is removably mounted in said light socket and light emitted by said light bulb shines outwardly through said cage, an electrical cord for electrically coupling said light socket to a power outlet being electrically coupled to said light socket; and an arm being attached to and extending upwardly away from said top wall; and a top magnet being attached to a distal end of said arm with respect to said top wall, said top magnet being substantially planar and lying a plane orientated substantially perpendicular to a longitudinal axis of said arm, said top magnet being configured to releasably couple said housing to a metallic surface attracted to magnets, said arm being telescopic and having a selectively adjustable length; and a lateral magnet being attached to said outer surface of said solid portion of said peripheral wall, said lateral magnet being positioned adjacent to said cage, said lateral magnet being configured to releasably couple said housing to a metallic surface attracted to magnets.

* * * * *